US007721473B2

(12) United States Patent
Lunn

(10) Patent No.: US 7,721,473 B2
(45) Date of Patent: May 25, 2010

(54) DRAGLINE EXCAVATOR BUCKET

(75) Inventor: Jason Ian Lunn, Cooks Hill (AU)

(73) Assignee: Bradken Resources Pty Limited, Mayfield West (AU)

( * ) Notice: Subject to any disclaimer, the term of this patent is extended or adjusted under 35 U.S.C. 154(b) by 0 days.

(21) Appl. No.: 12/326,809

(22) Filed: Dec. 2, 2008

(65) Prior Publication Data

US 2009/0139118 A1 Jun. 4, 2009

(30) Foreign Application Priority Data

Dec. 4, 2007 (AU) ..... 2007906606

(51) Int. Cl.
*E02F 3/60* (2006.01)

(52) U.S. Cl. ..... 37/398; 37/399; 37/401; 37/444

(58) Field of Classification Search ..... 37/398, 37/399, 401, 396, 444, 445
See application file for complete search history.

(56) References Cited

U.S. PATENT DOCUMENTS

| | | | | | |
|---|---|---|---|---|---|
| 833,333 | A * | 10/1906 | Newman | 37/399 |
| 887,990 | A * | 5/1908 | Weeks | 37/401 |
| 1,017,293 | A * | 2/1912 | Johnson | 37/396 |
| 1,095,303 | A * | 5/1914 | Vorhees | 37/401 |
| 1,132,917 | A * | 3/1915 | Dunbar | 37/398 |
| 1,134,558 | A * | 4/1915 | Sauerman | 37/401 |
| 1,228,554 | A * | 6/1917 | Hanot | 37/401 |
| 1,313,911 | A * | 8/1919 | Potter | 37/396 |
| 1,401,319 | A * | 12/1921 | Crawford | 37/401 |
| 1,438,453 | A * | 12/1922 | Miller | 37/401 |
| 1,498,162 | A * | 6/1924 | Gillespie | 37/398 |
| 1,522,078 | A * | 1/1925 | Rayburn | 37/401 |
| 1,589,907 | A * | 6/1926 | Smith | 37/401 |
| 1,597,005 | A * | 8/1926 | Ball et al. | 37/398 |
| 1,710,740 | A * | 4/1929 | Ljungkull | 37/399 |
| 1,777,626 | A * | 10/1930 | Rayburn | 37/398 |
| 1,804,175 | A * | 5/1931 | Massey | 37/401 |
| 2,525,528 | A * | 10/1950 | Deal | 37/398 |
| 3,915,238 | A * | 10/1975 | Hubbell | 172/26.5 |
| 4,731,941 | A * | 3/1988 | Beatty | 37/394 |
| 6,550,163 | B2 * | 4/2003 | Briscoe et al. | 37/398 |

FOREIGN PATENT DOCUMENTS

DE 3324836 A1 * 1/1985

* cited by examiner

*Primary Examiner*—Thomas A Beach
(74) *Attorney, Agent, or Firm*—Kenyon & Kenyon LLP

(57) ABSTRACT

A bucket for a dragline has a pivoted mounting by having two spaced pivotal arms, typically of arcuate or cranked form, pivotally connected to the outside of a rear wall of the bucket about pivot axes extending transverse to the bucket and below the upper rim of the bucket whereby pivotal connections at the upper end of each pivot arm may be disposed over the rim and within the bucket zone. Thus the pivot arms may be moved in use through greater than 90° from a position in which the bucket is vertically suspended. The pivot arms act to spread splayed hoist chains without a spreader bar.

8 Claims, 5 Drawing Sheets

DRAGLINE EXCAVATOR BUCKET

FIELD OF THE INVENTION

This invention relates to a suspension system for a bucket for a dragline excavator and to buckets so suspended and a dragline excavator having such a system.

BACKGROUND OF THE INVENTION

Dragline excavators may be categorised as falling within one of two general types; so-called "Conventional" draglines and Universal Dig Dump ("UDD") draglines. A Conventional dragline employs a single hoist rope and, to enable angular adjustment of the dragline bucket, a dump rope connects the drag rope to the forward end of the bucket by way of a pulley that, in turn, is connected with the hoist rope. By way of contrast, a UDD dragline employs two, forward and rearward, hoist ropes that are rigged to be operated independently of one another and, thus, without any interconnecting dump rope.

In the case of the Conventional dragline, the single hoist rope is connected to opposite side walls of the bucket by way of splayed hoist chains. Similarly, in the case of the UDD dragline, the rearward hoist rope is connected to opposite side walls of the bucket by way of splayed hoist chains. In each case the hoist chains are connected to lower, rearward regions of the respective side walls of the bucket by way of axially aligned trunnions. Also, in each case and in order to provide for clearance between the spayed hoist chains and the side walls of the bucket during tilting/turning of the bucket about the axis of the trunnions, a spreader bar is employed to increase the size of the effective splay angle between the hoist chains, and the effective width of the bucket is reduced (i.e., the side walls are tapered inwardly) in the region in which interference might occur between the hoist chains and the side walls of the bucket.

Depending upon the type of dragline and the bucket size employed in any given case, the spreader bar typically has a weight within the range 500 kg to 2,000 kg, and this creates two problems. It imposes a commensurate weight reduction on the bucket payload during each operating cycle, and bucket damage is regularly experienced due to collisions occurring between the spreader bar and the bucket during excavating operations. Also, with the bucket width being reduced to avoid interference with the hoist chains, the payload volume is reduced commensurately during each operating cycle.

Three different approaches are known to have been taken toward obviating the need for the spreader bar and thereby minimising the above mentioned problems. In one case the hoist chain trunnions have been moved toward the upper rim of the side walls of the bucket, but this has created problems with load dumping as a consequence of the tilting axis of the bucket being shifted to a level above that of the centre of gravity of the bucket. In another case, the hoist chain trunnions have been moved into the interior of the bucket, but this has resulted in a reduction in the payload capacity of the bucket and interference with the hoist chains. In the third case the hoist chain trunnions have been moved to the rear wall of the bucket but positioned at or below the level of the centre of gravity of the bucket and angled to correspond approximately with the splay angle of hoist chains. This results in excessive wear due to the trunnion axes being inclined with respect to the tilting axis of the bucket.

SUMMARY OF THE PRESENT INVENTION

Broadly defined, the present invention provides a dragline excavator bucket having two spaced-apart pivot arms pivotally connected to a rear wall of the bucket and connectable to a pair of splayed hoist chains. Each of the pivot arms is pivotal about a pivot axis that extends transverse to the bucket and substantially parallel to the rear wall and is located below the rim of the rear wall, and the pivot arms are shaped to permit relative movement of the bucket and the pivot arms through an angle greater than 90° whereby the bucket may be moved from a substantially vertical disposition to a carry angle greater than 0° to the horizontal.

Each of the pivot arms may optionally have any shape that accommodates the relative movement of the bucket and the pivot arms through the angle greater than 90° and which, therefore, avoids the possibility of interference between the pivot arms and the bucket. Thus, each pivot arm may be formed, for example, with two arm portions that are separated by an obtuse included angle. As a further example, each pivot arm may have an arcuate (i.e., "boomerang") shape and be dimensioned to extend around the rim of the bucket wall with clearance between the pivot arm and the rim of the bucket wall when the bucket is in a carry position.

The two pivot arms desirably share a common pivot axis and, in such case, the position of the common pivot axis may optionally be determined on a case-by-case basis to take into account the operational requirements of the bucket; for example for "chop cutting" a 75° high wall and/or "bottom" excavation. In one embodiment of the invention the common pivot axis is located on a line passing through the rear wall of the bucket and the centre of gravity ("CG") of the bucket when unladen. More specifically, the pivot axis may be located slightly above the CG, and in a particular embodiment of the invention the pivot axis may be located above the level of the CG and on a line that makes an angle $\alpha$ of less than about 15° to the floor of the bucket. The angle $\alpha$ desirably is between 0° and 15°.

The invention may optionally be embodied in both Conventional and UDD draglines but it has greater application and can more usefully be embodied in UDD draglines; that is with one hoist rope connected with the pivot arms at the rearward end of the bucket and with the second hoist rope connected, typically by splayed hoist chains, to the front "ring" of the bucket.

The invention will be more fully understood from the following description of an illustrative embodiment of a bucket for use in a UDD dragline excavator. The description is provided with reference to the accompanying drawings.

DETAILED DESCRIPTION OF ILLUSTRATIVE EMBODIMENT OF THE INVENTION

Figure 1:
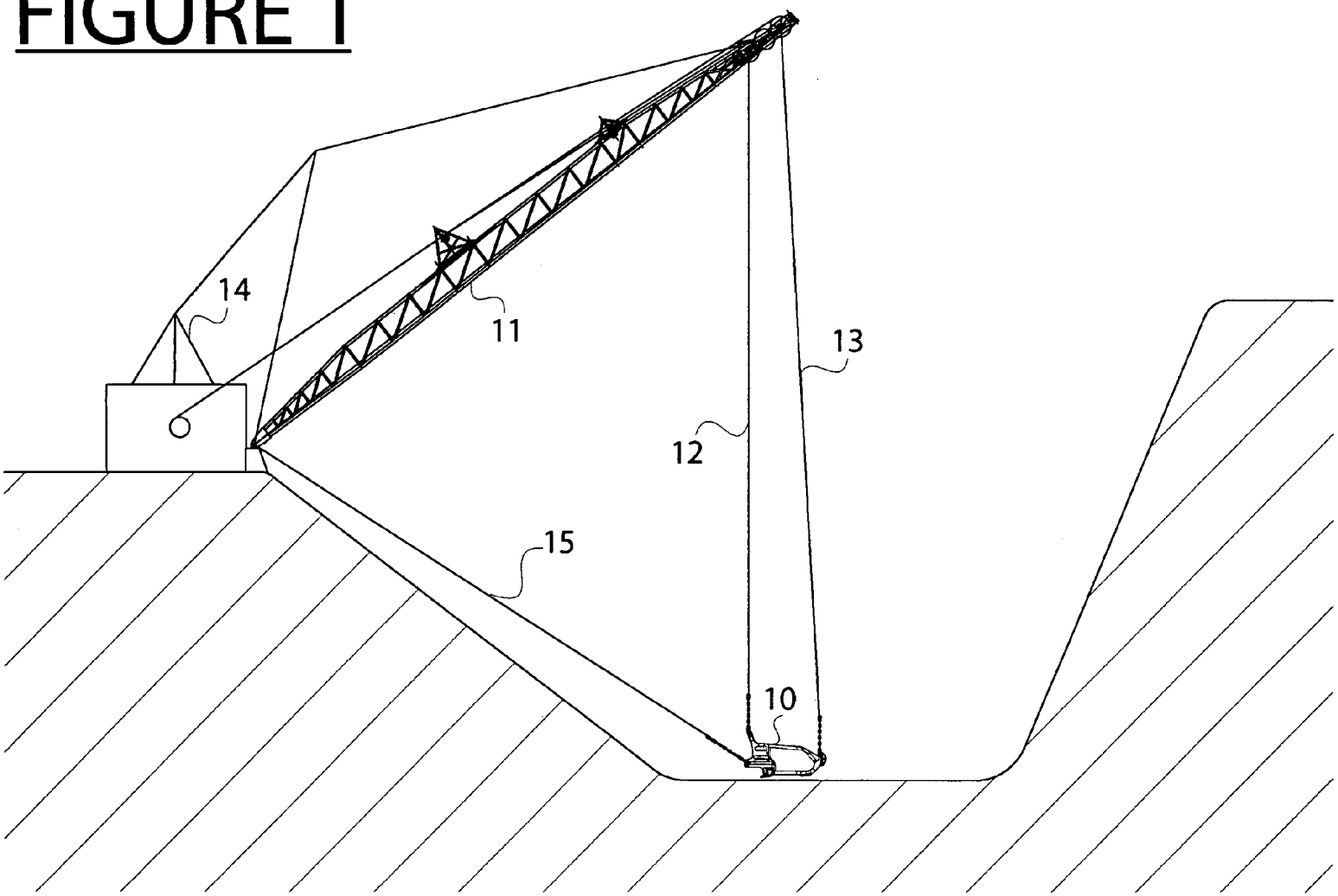
FIG. 1 is a diagrammatic representation of a UDD dragline excavator modified to include an embodiment of the invention and in an operational (e.g., strip mining) environment.
Figure 2:
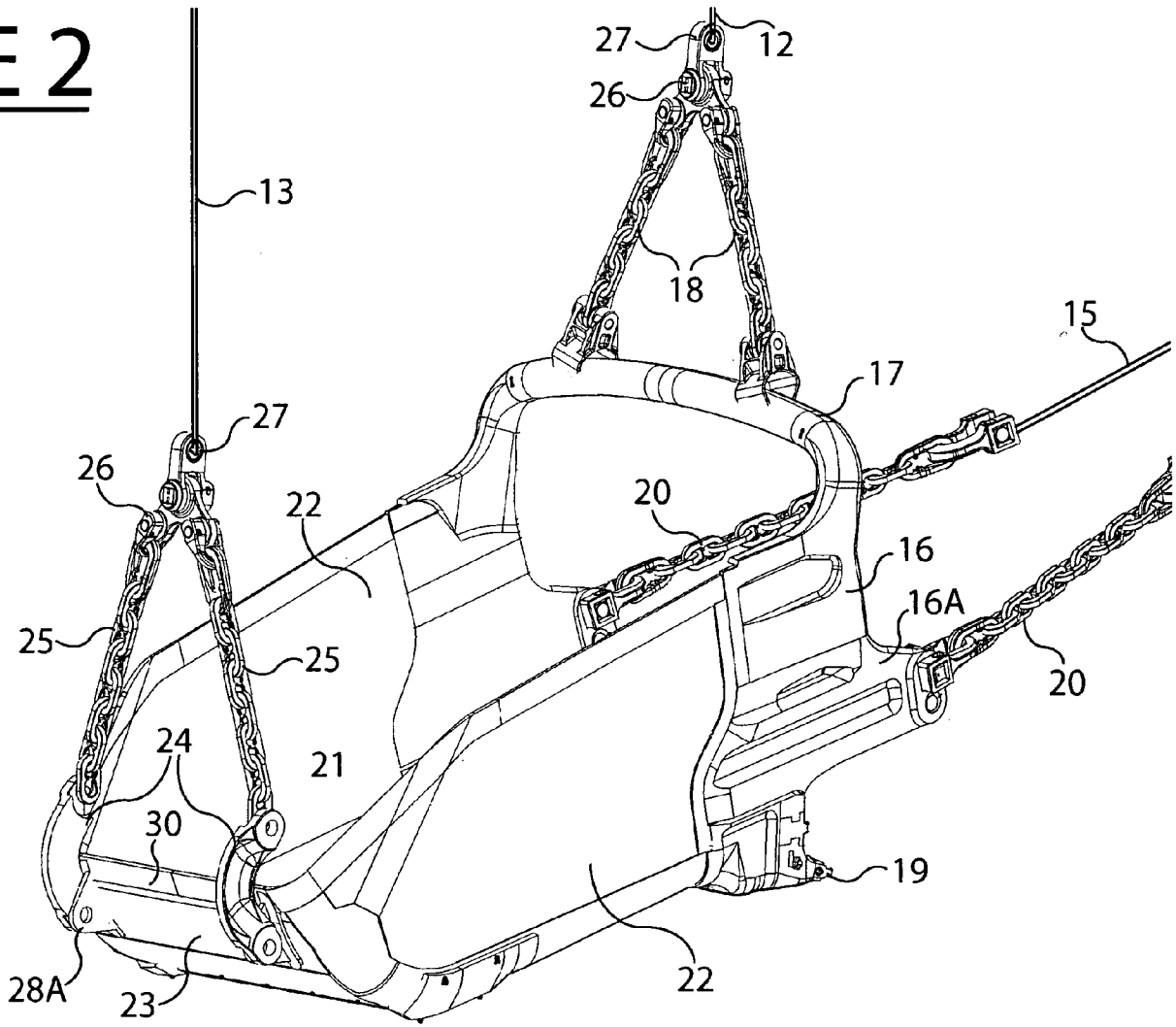
FIG. 2 is a perspective view of a bucket component of the dragline excavator.
Figure 3B:
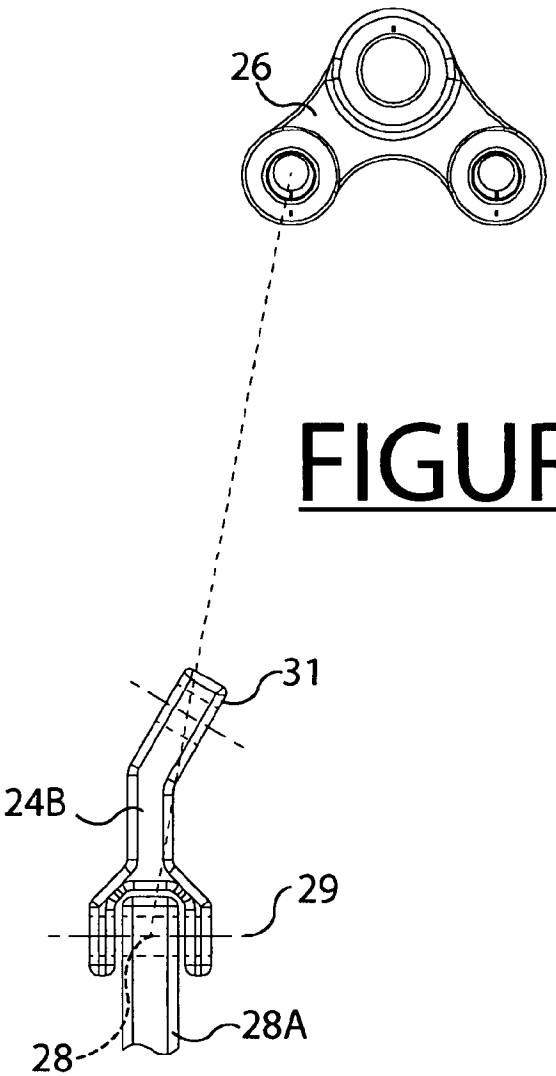
FIG. 3B shows a scrap end view of an alternative form of pivot arm, again as seen in the direction of arrow 3 in FIG. 2.
Figure 3A:
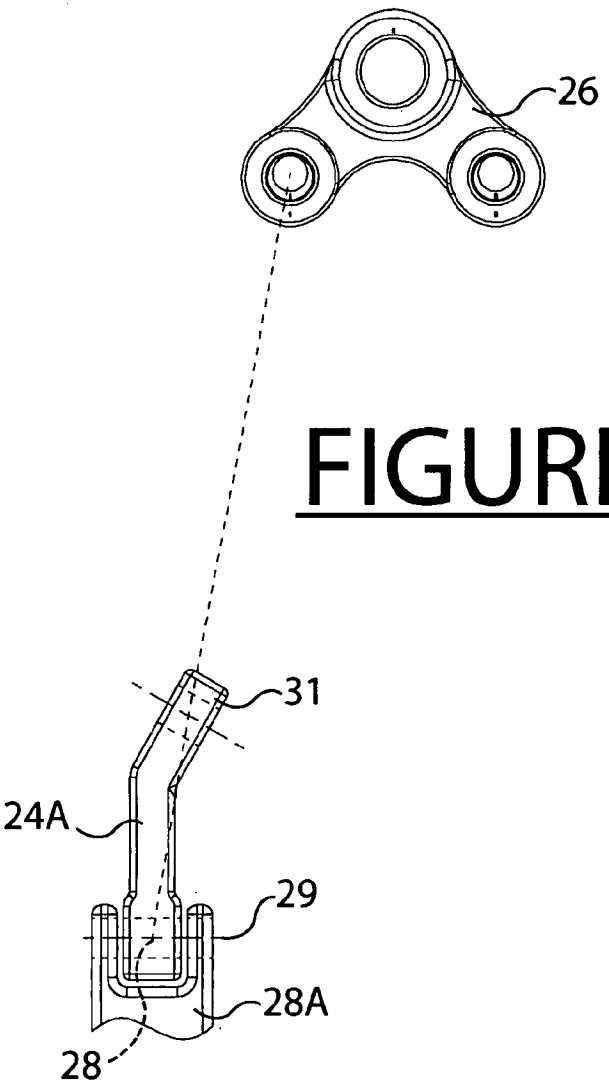
FIG. 3A shows a scrap end view of one pivot arm of the bucket, as seen in the direction of arrow 3 shown in FIG. 2.
Figure 4:
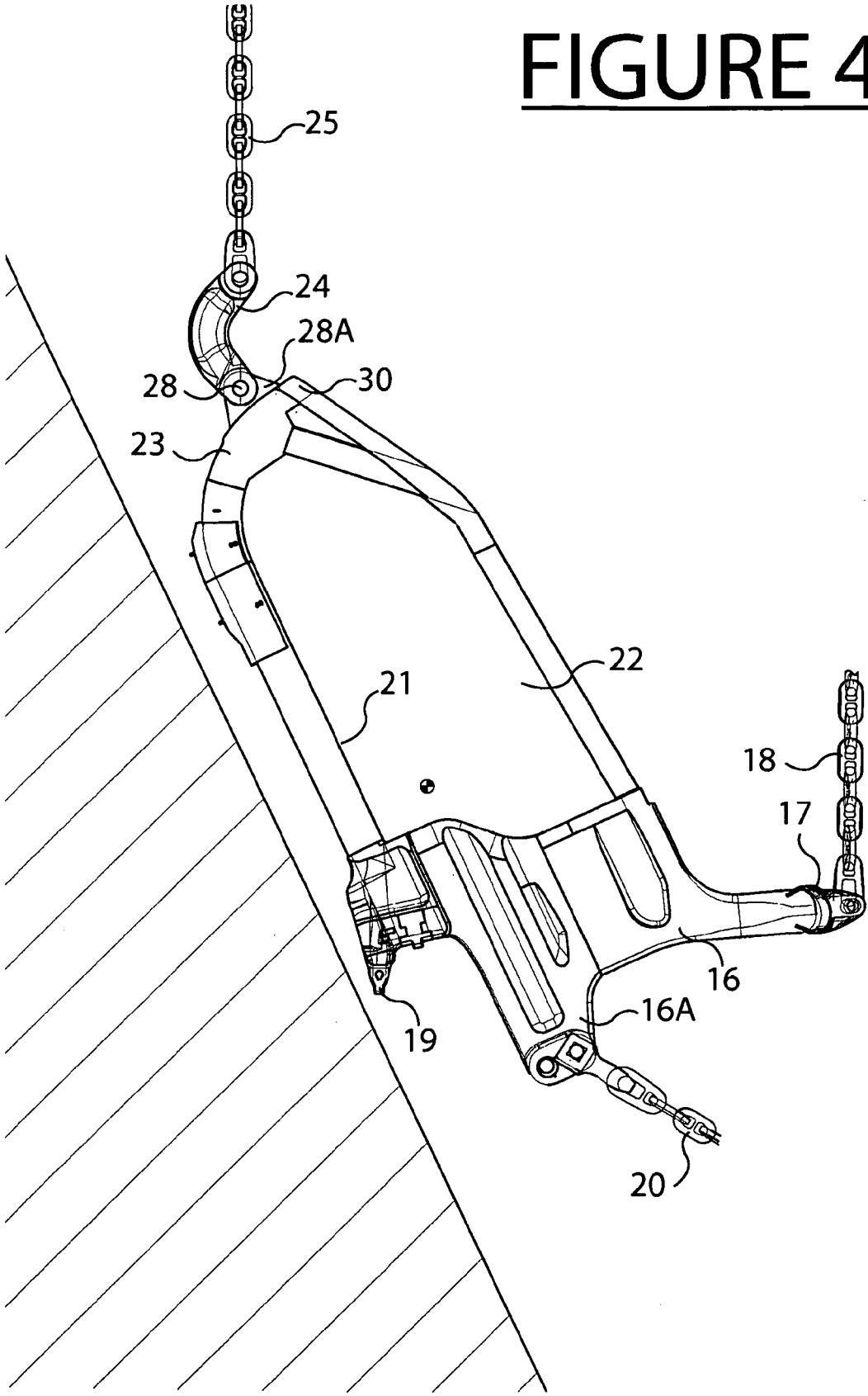
FIG. 4 shows a side view of the bucket when suspended in working relationship to a near-vertical wall of an excavation site.
Figure 5:
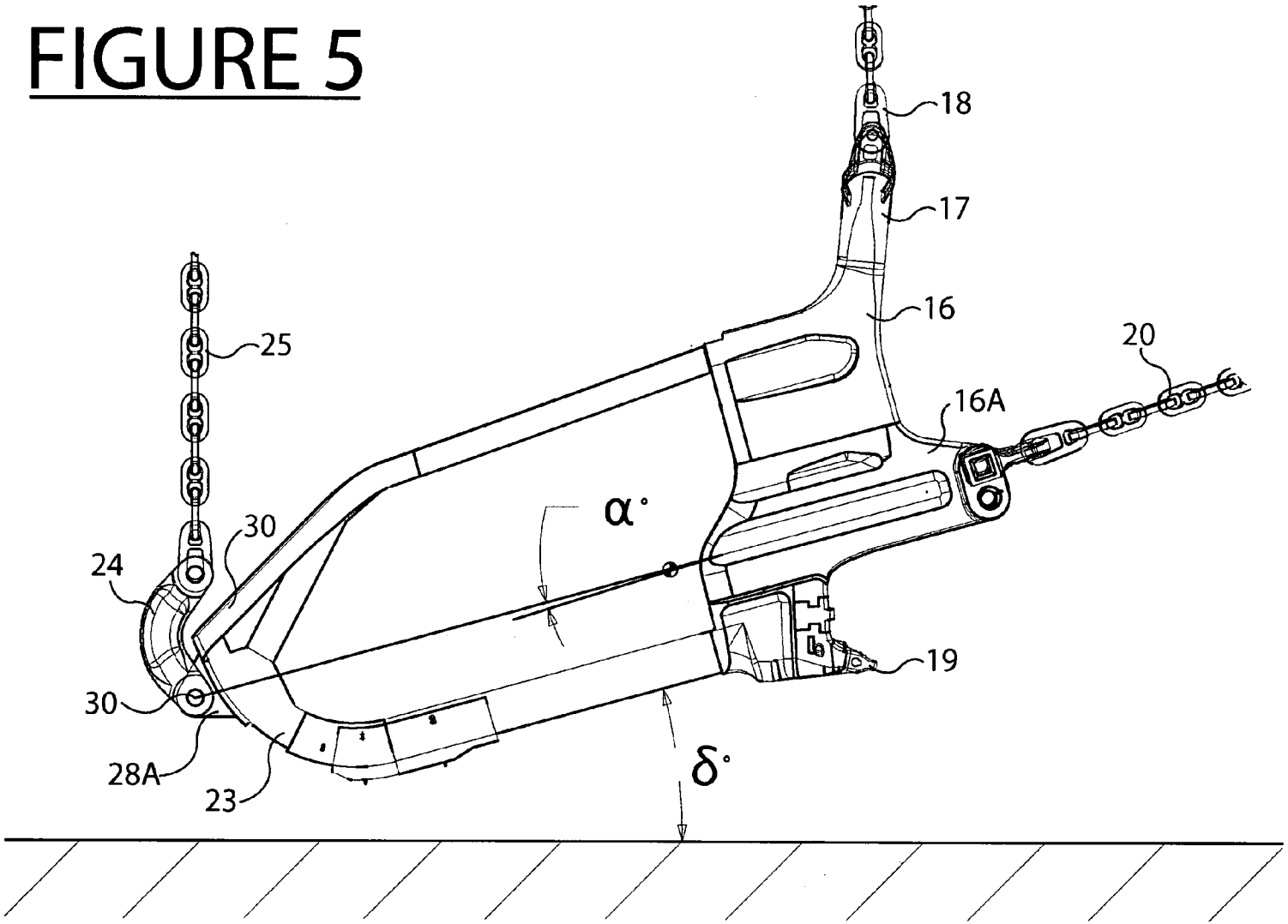
FIG. 5 shows a side view of the bucket when suspended in a carry position above a horizontal floor of an excavation site.

As illustrated in FIG. 1, the dragline excavator comprises a dragline bucket 10 which is suspended from a truss-structured boom 11 by forward and rearward hoist ropes 12 and 13 and which is connected to power plant 14 by a drag rope 15. The bucket 10 is manoeuvred by means of the hoist and drag ropes 12, 13 and 14 during excavating and dumping operations. For example the bucket can be manoeuvred during so-called chop cutting as indicated in FIG. 4 during excavation, during carry operations as indicated in FIG. 5 and also during dumping operations, for example to the side or behind the excavation site. The boom 11 might typically have a length of 120 m. and the bucket might typically have a width of 4.5 m. and a carrying capacity of 54 $m^3$.

The bucket 11 is constructed in a generally conventional way, in that it includes a fully cast front ring 16 which includes an arch bar 17 with which the forward hoist rope 12 is shackle-connected by way of splayed hoist chains 18. Replaceable excavator teeth 19 are mounted to the front ring 16, and the drag rope 15 is connected with forwardly projecting lugs 16A of the front ring by way of splayed drag chains 20.

Extending rearwardly from the front ring 16 are a bucket floor 21, and parallel side walls 22 that taper downwardly to a rear (or end) wall 23 which has a height in the region of 50% to 70% of that of the side walls.

By way of contrast with prior art excavator buckets, the bucket as illustrated in FIGS. 2 to 5 has a pair of spaced-apart pivot arms 24 pivotally connected to the rear wall 23 of the bucket. The pivot arms are connected with the rear hoist rope 13 by way of splayed hoist chains 25, an equaliser connector 26 and a hoist link-socket assembly 27. The two pivot arms 24 are mounted by way of pivot pins 28 to lug portions 28A of the rear wall 23 and they are pivotal about a common pivot axis 29 that is located below the rim 30 of the rear wall of the bucket. The pivot axis 29 extends in a horizontal direction (i.e., parallel with the transverse direction of the bucket floor 21) and, hence, parallel with the axis about which the bucket tilts (i.e., rotates) in moving between set angles for dig, carry and dump modes of operation.

The pivot arms 24 are shaped (as seen in side elevation) to permit movement of the bucket 10, relative to the pivot arms, through an angle greater than 90°, so that the bucket may be moved from the substantially vertical disposition shown in FIG. 4 to a carry angle δ greater than 0° and normally between 0° and ~20° to the horizontal, as shown in FIG. 5. Thus, as illustrated, each pivot arm 24 has a boomerang (or arcuate) shape and is dimensioned to extend around the rim 30 of the rear wall of the bucket with clearance (between the pivot arm and the bucket rim) when the bucket is in the extreme carry position.

In the illustrated embodiment of the invention, the common pivot axis 29 of the pivot arms 24 is located at a level slightly above the (unladen) CG of the bucket and on a line that makes an angle α of between 0° and 15° (and more normally between 1° and ~5°) to the floor 21 of the bucket.

As seen in end elevation (FIGS. 3A and 3B), the alternative types of the pivot arms 24 (i.e., pivot arms 24A and 24B) have portions 31 of their length inclined inwardly to match the splay angle of the hoist chains 25.

The claims defining the invention are as follows:

1. A dragline excavator bucket having two spaced-apart pivot arms pivotally connected to a rear wall of the bucket and connectable to a pair of splayed hoist chains, each of the pivot arms being pivotal about a pivot axis that extends transverse to the bucket and generally parallel to the rear wall and is located below the rim of the rear wall, wherein each pivot arm has an arcuate shape and is dimensioned to extend around the rim of the rear wall of the bucket with clearance between the pivot arm and the rim of the bucket wall when the bucket is in a carry position whereby the pivot arms permit relative movement of the bucket and the pivot arms through an angle greater than 90°, so that the bucket may be moved from a substantially vertical disposition to a carry angle greater than 0° to the horizontal.

2. A dragline excavator bucket having two spaced-apart pivot arms pivotally connected to a rear wall of the bucket and connectable to a pair of splayed hoist chains, each of the pivot arms being pivotal about a pivot axis that extends transverse to the bucket and generally parallel to the rear wall and is located below the rim of the rear wall, wherein each pivot arm has shape and dimensions to extend around the rim of the rear wall of the bucket with clearance between the pivot arm and the rim of the bucket wall when the bucket is in a carry position whereby the pivot arms permit relative movement of the bucket and the pivot arms through an angle greater than 90°, so that the bucket may be moved from a substantially vertical disposition to a carry angle greater than 0° to the horizontal.

3. The dragline excavator bucket as defined in claim 2, wherein the two pivot arms share a common, horizontal pivot axis.

4. The dragline excavator bucket as defined in claim 3 wherein the pivot axis is located above the centre of gravity of the bucket when unladen and on a line that makes an angle of less than about 15° to the floor of the bucket.

5. The dragline excavator bucket as defined in claim 4, wherein the angle of the line is in the range of 1° to 15°.

6. The dragline excavator bucket as defined in claim 2, wherein the pivot arms are respectively mounted close to the junction of the rear wall with a side wall of the bucket and the pivot arms are arranged to maintain, in use, the hoist chains in splayed relationship.

7. The dragline excavator bucket as defined in claim 2, wherein each pivot arm is pivotally connected to a mounting bracket extending rearwardly of the rear wall and about an axis parallel to the rear wall, and each pivot arm has an upper end portion arranged to be pivotally connected to a hoist chain and having an inclined form to substantially match the splay angle of the hoist chain.

8. A dragline having an excavator bucket as claimed in claim 2, mounted via a control hoist system and supporting the bucket through splayed hoist elements connected to the pivot arms.

* * * * *